US007084381B2

(12) United States Patent
Davids et al.

(10) Patent No.: US 7,084,381 B2
(45) Date of Patent: Aug. 1, 2006

(54) METHOD AND APPARATUS FOR CONTROLLING PART MOVEMENT

(76) Inventors: Ronald R Davids, 3964 Elaines Way, Slinger, WI (US) 53086; Robert M Stone, Sr., N2323 County Hwy. SS, Campbellsport, WI (US) 53010

( * ) Notice: Subject to any disclaimer, the term of this patent is extended or adjusted under 35 U.S.C. 154(b) by 0 days.

(21) Appl. No.: 10/708,938

(22) Filed: Apr. 1, 2004

(65) Prior Publication Data

US 2005/0236401 A1 Oct. 27, 2005

(51) Int. Cl.
*H05B 6/10* (2006.01)

(52) U.S. Cl. ..... 219/635; 219/637; 219/639; 148/510

(58) Field of Classification Search ..... 219/635, 219/637, 639, 634, 640, 643, 660, 663, 664–665, 219/667, 653, 650, 656, 632, 674; 148/510, 148/575, 573, 586, 508, 567, 572, 574, 593, 148/594, 643; 29/897.2, 897.312, 525.13, 29/525.14; 266/90, 104; 414/274, 16, 17
See application file for complete search history.

(56) References Cited

U.S. PATENT DOCUMENTS

| | | | | |
|---|---|---|---|---|
| 2,376,476 | A * | 5/1945 | Chatelain | 82/127 |
| 3,755,010 | A | 8/1973 | Moliterno | 148/153 |
| 5,104,462 | A | 4/1992 | Bishop | 148/128 |
| 5,433,800 | A | 7/1995 | Bishop | 148/510 |
| 6,477,774 | B1 * | 11/2002 | Marando et al. | 29/897.2 |

* cited by examiner

*Primary Examiner*—Quang Van
(74) *Attorney, Agent, or Firm*—John K. McCormick

(57) ABSTRACT

There is disclosed herein an apparatus and a method in which a workpiece is loaded into the apparatus and the apparatus then moves and positions the workpiece in a multitude of directions based upon the directions and controls supplied to the apparatus through either a computer and applets, a programmable controller and/or through manual intervention. The apparatus can move the workpiece linearly to a predetermined position, rotate the workpiece in a continuous motion, index the workpiece incrementally and/or do any combination of those movements. The apparatus can also control other components such as turning coolant and/or quench valves on and off as desired or powering working tools such as an induction hardening coil. The workpiece is loaded directly on the center of the apparatus movement and positioning device for increased capacity loading and precision movement.

4 Claims, 7 Drawing Sheets

METHOD AND APPARATUS FOR CONTROLLING PART MOVEMENT

BACKGROUND OF INVENTION

This invention relates to the field of controlling and positioning a workpiece in a manufacturing environment. For explanation purposes, the manufacturing process known as induction hardening will be used to aid in the comprehension of the invention. The use of this example is not meant to limit the scope of the background or of the invention to induction hardening, but rather to aid in the understanding of the invention. The proposed invention may be useful in other fields and endeavors as well, such as machining, milling, assembly and so on.

In the hardening process, the surface layers of the workpiece are heated to about 1000 degrees centigrade, and upon quenching, the surface layer is transformed to the martensitic phase. Martensite provides high surface hardness and enhanced resistance to fatigue. Induction hardening is typically used to harden gear teeth, shafts, splines, housings, hubs, yokes and so on. Currently, there are a variety of methods and equipment available for positioning and controlling production work pieces for induction hardening. These methods are commonly called scan induction hardening, pop-up induction hardening and lift and index induction hardening.

Scan hardening is one of the most popular means for induction hardening of steel. It is done to enhance specific properties of the material that include such things as strength, fatigue resistance, and wear resistance. In scan hardening, the workpiece to be hardened is held between centers that are mounted on an "L" shaped cantilever. The induction coil is typically a single turn, or part of a turn, of a heavy section of copper conductor that surrounds the workpiece, incorporating water passages for cooling, and is supplied by a low voltage, high frequency, alternating current. Usually, the coil remains stationary and the workpiece is moved through the center of the coil during hardening. It is, however, quite possible for the coil to be moved and for the workpiece to remain stationary. Where the workpiece is circular in cross-section, the workpiece is usually rotated as it passes through the coil so as to distribute the hardening uniformly around the periphery which might otherwise be uneven due to small asymmetries of heating caused by coil construction or small irregularities in the quench ring. As electrical current is applied to the coil, the workpiece is heated up to the desired temperature. As the workpiece passes through the coil, a quenching fluid is applied to the heated workpiece and hardening occurs. This type of system is somewhat flexible with respect to workpiece length and, to some extend, outside diameter. Induction scanners can vary scanning speed and power, which control the amount of heat applied to different areas of the workpiece. Depending upon the workflow of work pieces, an induction scan hardening system can be vertical, horizontal or at an angle. Vertical scanners are the most common.

Once the workpiece is heated and quenched, the "L" shaped cantilever is returned to its home position so that the workpiece can be removed and the next workpiece put in for processing. The raising and lowering of the workpiece on the cantilever is accomplished by moving the cantilever with either an electrical-mechanical device, such as a servomotor and drive gears or pulleys, or through the use of hydraulics. The rotation is typically accomplished with an electrical-servo mechanism. This type of scanning is reasonably precise, but is limited in its weight capacity due to the use of the cantilever mechanism and the forces applied to the lifting mechanism.

Another method for induction hardening is called pop-up induction hardening. A workpiece is held in place with a fixture designed to hold the workpiece, instead of centers, although centers could be utilized. The workpiece is then moved into place, popped up, into position with the induction coil. The induction coil then heats the entire surface to the desired temperature, the workpiece is quenched, and then the fixture drops back down to its home position for workpiece removal and the positioning of a new workpiece. A similar method for large work pieces is to place the workpiece in a stationary fixture and have the induction coil move into the proper position prior to heating and quenching the workpiece. This can be done in a vertical, horizontal or angular position and with either electrical-servo mechanism, pneumatics or with hydraulics.

A third method for induction hardening is called the lift and index induction hardening method. This is typically used for complex shapes such as gears, splined shafts or inside splined shafts where it is desired to harden the gear tooth surface or the splined shaft surfaces. There are other uses as well. In this process, the workpiece is held by either centers or a fixture. Typically, in a vertical machine, the workpiece is raised vertically into position next to the inductor. The inductor then moves in horizontally between two teeth or splines. The tooth surface or spline is then heated to the desired temperature and quenched. The induction coil then backs away from the gear tooth or spline and the gear or spline is then rotated or indexed to the next tooth to be hardened. This process continues until all of the teeth have been heated to the desired temperature and quenched. The workpiece is then returned to the home position for removal. This can be done in the vertical, horizontal or angular position through the use of either electrical-servo mechanisms or with hydraulics.

The current methods have some limitations to them. First and foremost is that each of the methods described above are separate and distinct induction hardening processes. By this, we mean that the method for scan induction hardening does not provide for a means to lift and index. Similarly, the means for lifting and indexing does not provide for a continuous scan of a workpiece. Neither of these induction hardening processes provide for a means to do "Pop Up" induction hardening.

Secondly, the existing methods utilize a table or "L" shaped cantilever for positioning the workpiece. This significantly reduces the weight bearing capacity of the induction heating device due to the forces and loading on the cantilever. The current solution to this is to simply build a larger machine for heavier work pieces. This solution costs more and occupies an additional amount of floor space.

Thirdly, in the lift and index induction hardening process, once the workpiece is in position, the inductor must be moved in and out of position to allow for the workpiece to be rotated in order for the next tooth to be aligned with the induction coil. The induction coils are typically much larger and heavier that the production work pieces, which causes greater wear on the equipment and on the accuracy of positioning the induction coil.

SUMMARY OF INVENTION

This disclosure describes an apparatus and a method for securing, moving and positioning a workpiece in a variety of ways within a machine so that work can be performed upon the workpiece. Briefly described in architecture, the apparatus has an electrical actuator, a shaft having a ball screw groove and a ball spline groove, a motor, a ball screw nut fitted about the shaft, a ball spline and a ball spline nut fitted about the shaft and an independent bearing fitted to the top of the shaft. A servo-motor is connected to the ball screw and a second servo-motor is connected to the ball spline. A programmable controller or computer is connected to the servo motors. Software or applets within the computer control the commands for turning on or off the servo-motors and in controlling their direction of movement and their speed. This allows the movement and positioning device to cause the workpiece to operate in a linear motion, a linear motion with rotation, a lift and hold motion, and/or a lift, drop, index and lift motion. In addition, the invention has the means for controlling the clamping mechanism for holding the workpiece, the turning on and off of the coolant and/or quench medium, and the activation of power to the induction coil assembly or other working tools.

BRIEF DESCRIPTION OF DRAWINGS

A system and method according to the invention will be described in more detail by means of a preferred embodiment with reference to the appended drawings in which.

DETAILED DESCRIPTION

To facilitate the description of the invention, it is useful to define some terminology solely for this purpose. The terminology should not be construed as limiting the generality of the invention. For the purpose of this description:

1. Computer represents any type of computer, programmable controller or manual input used in providing directions for any of the components connect to the computer;

2. Software represents the programming code or applets utilized by the computer;

3. The electrical connection topology of the computer and the other components is not limited to hardwiring and may include wireless communication.

The present invention consists of an apparatus and a method for the control and movement of a workpiece, and the actuation of a tool, such that the apparatus can provide the workpiece with linear motion, rotational motion, lift and hold motion, drop and index motion or any combination of these motions. Although the invention is described in connection with the drawings, there is no intent to limit the invention to the embodiment or embodiments disclosed therein. On the contrary, the intent is to include all alternatives, modification and equivalents included within the scope and spirit of the invention as defined by the appended claims. In addition, to aid in the description of the invention, the process of induction hardening will be used for example purposes only. However, the invention and its alternatives, modifications, derivatives and/or equivalents in other applications are meant to be included within the scope and spirit of the invention as defined by the appended claims.

Figure 1:
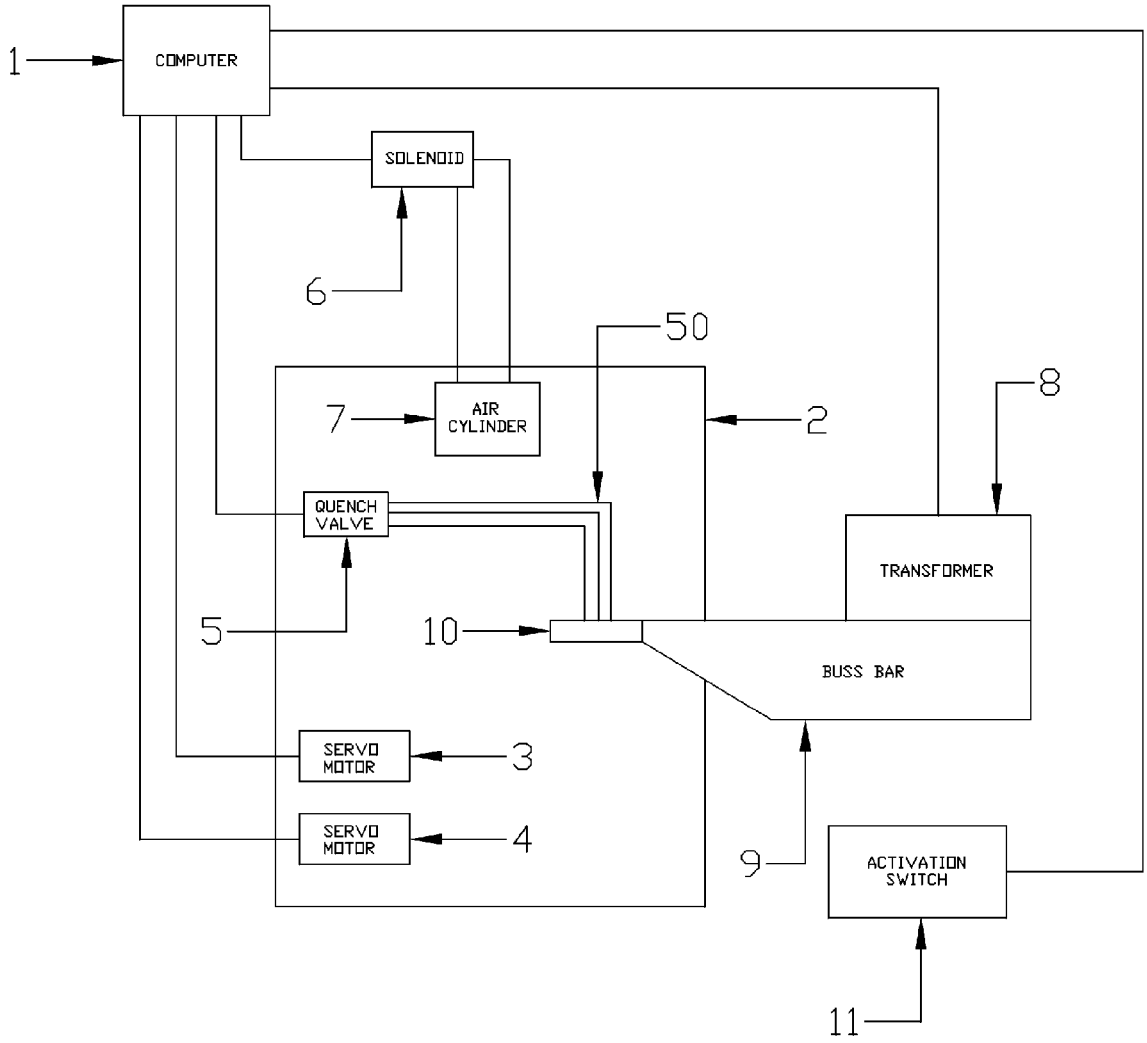
FIG. 1 is a general overview schematic of the overall invention.

FIG. 1 shows the overall topology of the apparatus. In FIG. 1 a computer 1 is connected electronically to six other components. The software programs or applets (not shown) residing in the computer 1 are used to control five of the six components connected to the computer 1. The five components that are controlled by computer are the first servo-motor 3, the second servo-motor 4, the quench valve 5, the pneumatic solenoid 6, and the power transformer 8. The activation switch 11 is a safety feature which consists of a manual switch that must be activated in order to allow the computer 1 to activate any of the five other components attached to the computer 1. The servo motors 3 and 4, the quench valve 5, the air cylinder 7, the buss bar 9, and the induction coil assembly 10 are all attached to the machine 2 in the preferred embodiment, although some components need not be connected directly to the machine 2. FIG. 1 also shows the pneumatic solenoid 6 connected to an air cylinder 7. The transformer 8 is also shown connected to the buss bar 9 which is connected to the induction coil assembly 10. Flexible quench hosing 50 is attached to the quench valve 5 and the induction coil assembly 10.

Figure 2:
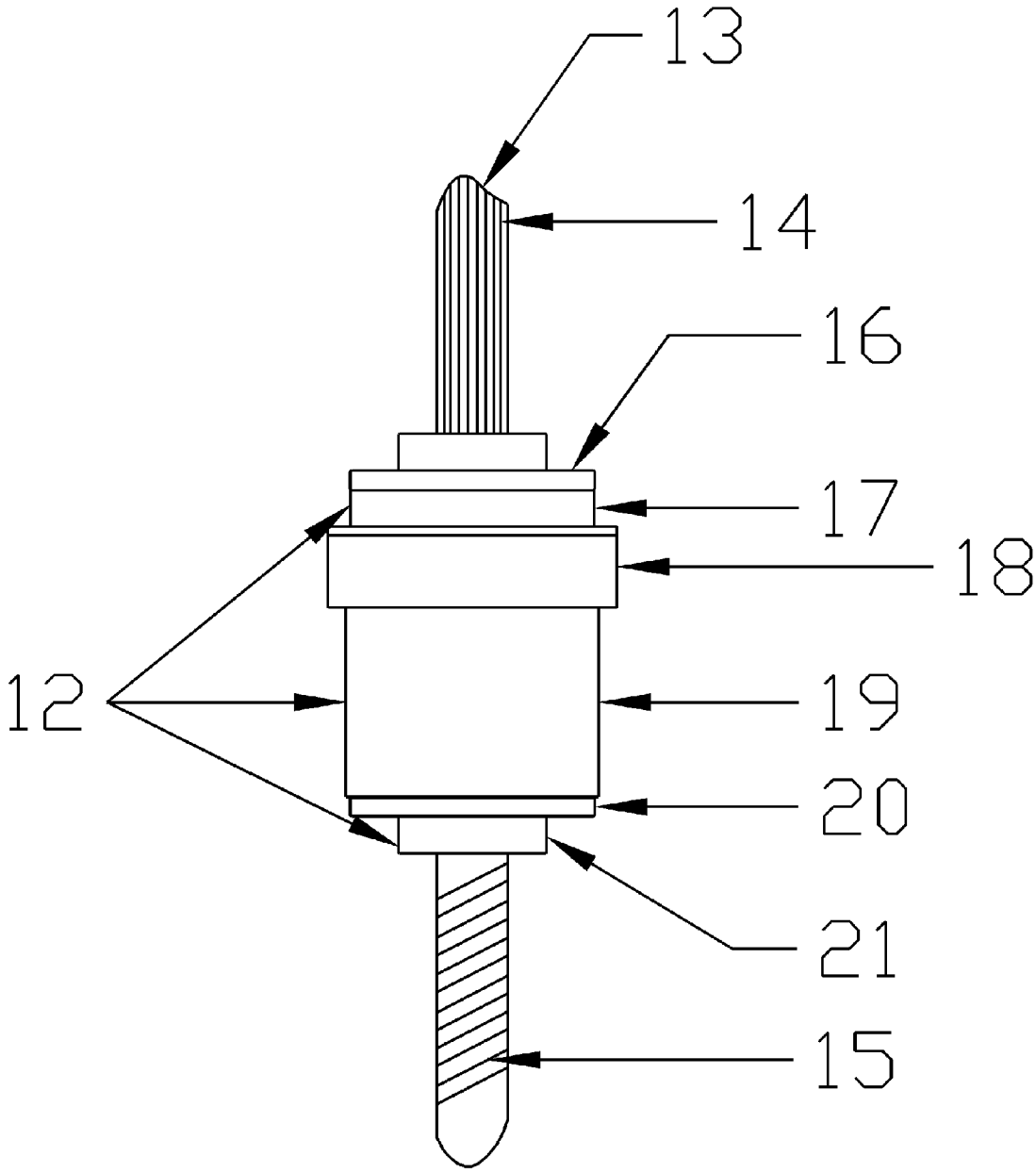
FIG. 2 is a view of the actuator used in the machine for carrying out the process according to the invention.

FIG. 2 shows the exterior of the ball screw/ball spline assembly 12. The ball screw/ball spline assembly 12 consists of a composite shaft 13 that has both spline grooves 14 and ball screw grooves 15 on the exterior of the composite shaft. The ball screw/ball spline assembly 12 also shows a ball spline nut 16, a ball spline housing 17, a ball spline flange 18, a ball spline flange to ball screw flange housing 19, a ball screw flange 20 and a ball screw nut 21.

Figure 3:
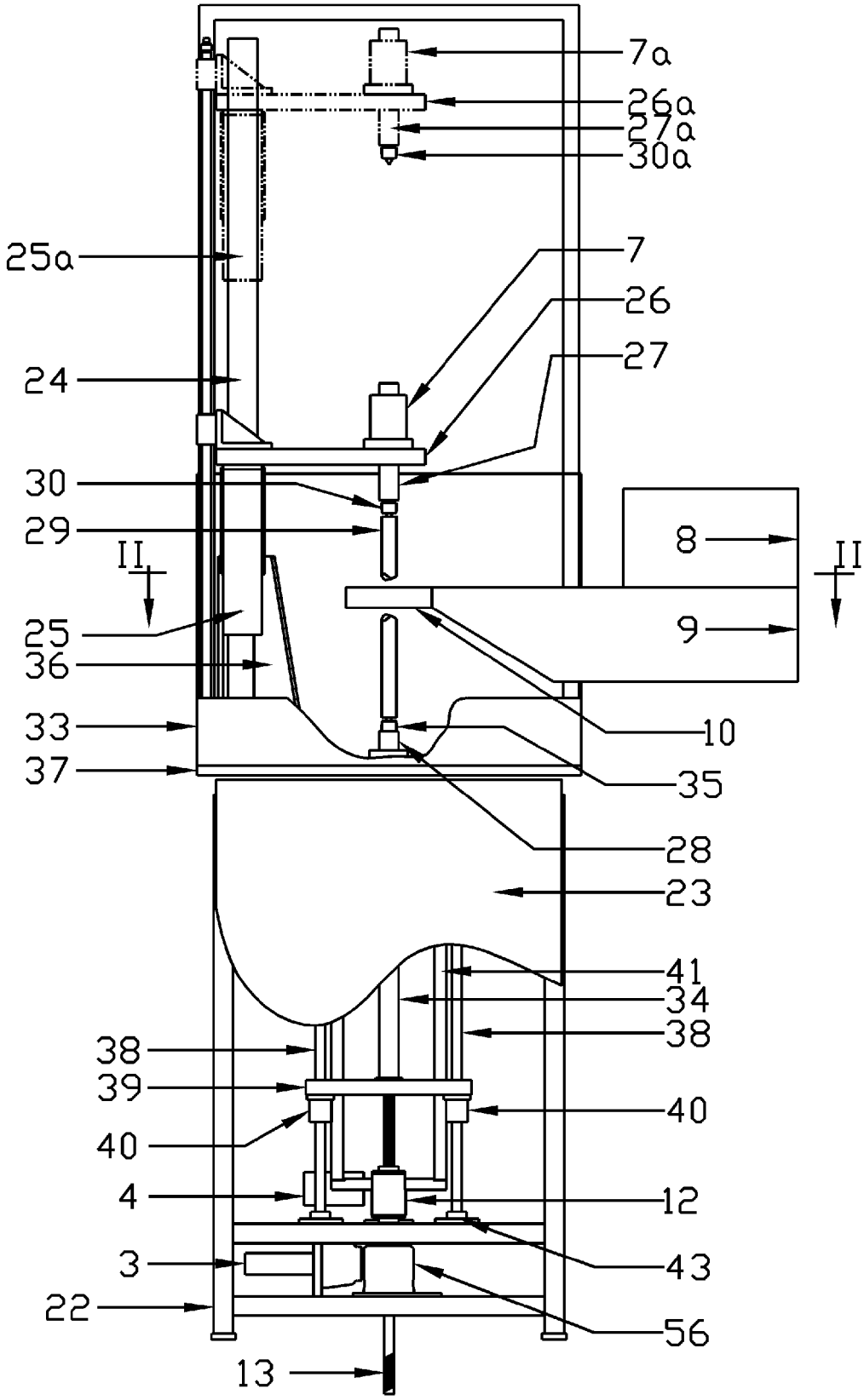
FIG. 3 is a frontal view of a machine for carrying out the process according to the invention.

FIG. 3 is a frontal view of the machine made according to the present invention. The machine frame 22 is shown in a vertical position however the machine could be mounted in a horizontal or angular fashion with a minor modification to the upper frame cover 33, which acts as a quench spray container and drain pan. The machine comprises the frame 22 which, together with the base plate 37, supports the slideway column 24. The slideway column 24 serves as a guide for carriage 25 having at its upper end the support plate 26, the tail stock 27 and the air cylinder 7. FIG. 3 also shows the carriage 25*a*, the air cylinder 7*a*, the support plate 26*a* the tail stock 27*a* and the tail stock center 30*a* at their fully extended top position.

The head stock 28 is connected directly to the lift shaft 34 which passes through the base plate 37. Workpiece 29 is shown supported on centers 30 and 35 on the tail stock 27 and head stock 28, tail stock 27 being provided with an upper center 30 and head stock 28 provided with a lower center 35. The air cylinder 7 provides positive pressure on the tail stock 27 and tail stock center 30 in order to keep the workpiece 29 securely clamped between the upper tail stock center 30 and the lower head stock center 35. The air pressure is turned on and off by the pneumatic solenoid 6 at the direction of the software resident in the computer 1 shown in FIG. 1. A support gusset 36 adds rigidity and support to the invention.

The position of the lift shaft 34 is directly on center with the workpiece 29. Whereas other designs utilize a cantilever to position and secure the workpiece, this invention loads the lift shaft directly on center allowing for substantially greater load carrying capacity and greater life of the bearings and bearing surfaces.

In FIG. 3, an induction coil assembly 10 is shown surrounding the workpiece 29. The induction coil assembly 10 is attached to a buss bar 9 which is connected to the transformer 8. The software (not shown) resident in the computer 1 shown in FIG. 1 directs the transformer 8 to deliver electrical power through the buss bar 9 to the induction coil assembly 10, thereby charging the induction coil assembly 10.

Through the direction of the software (not shown) resident in the computer 1, the first servo motor 3 will drive the gear or pulley drive system 56 which in turn will drive the ball screw (not shown) in the ball screw/ball spline assembly 12 thereby causing the composite shaft 13 to travel vertically up or down at the direction of the software in the computer 1. The standoff support 41 adds rigidity and support to the invention. The lower half of the invention is enclosed by the lower frame cover 23.

Through the direction of additional software (not shown) resident in the computer 1, second servo motor 4 will drive the gear or pulley drive system 57 (not shown) which in turn will drive the ball spline (not shown) in the ball screw/ball spline assembly 12 thereby causing the composite shaft 13 to rotate left or right in either a continuous or indexing fashion, depending upon the software directions.

Figure 4:
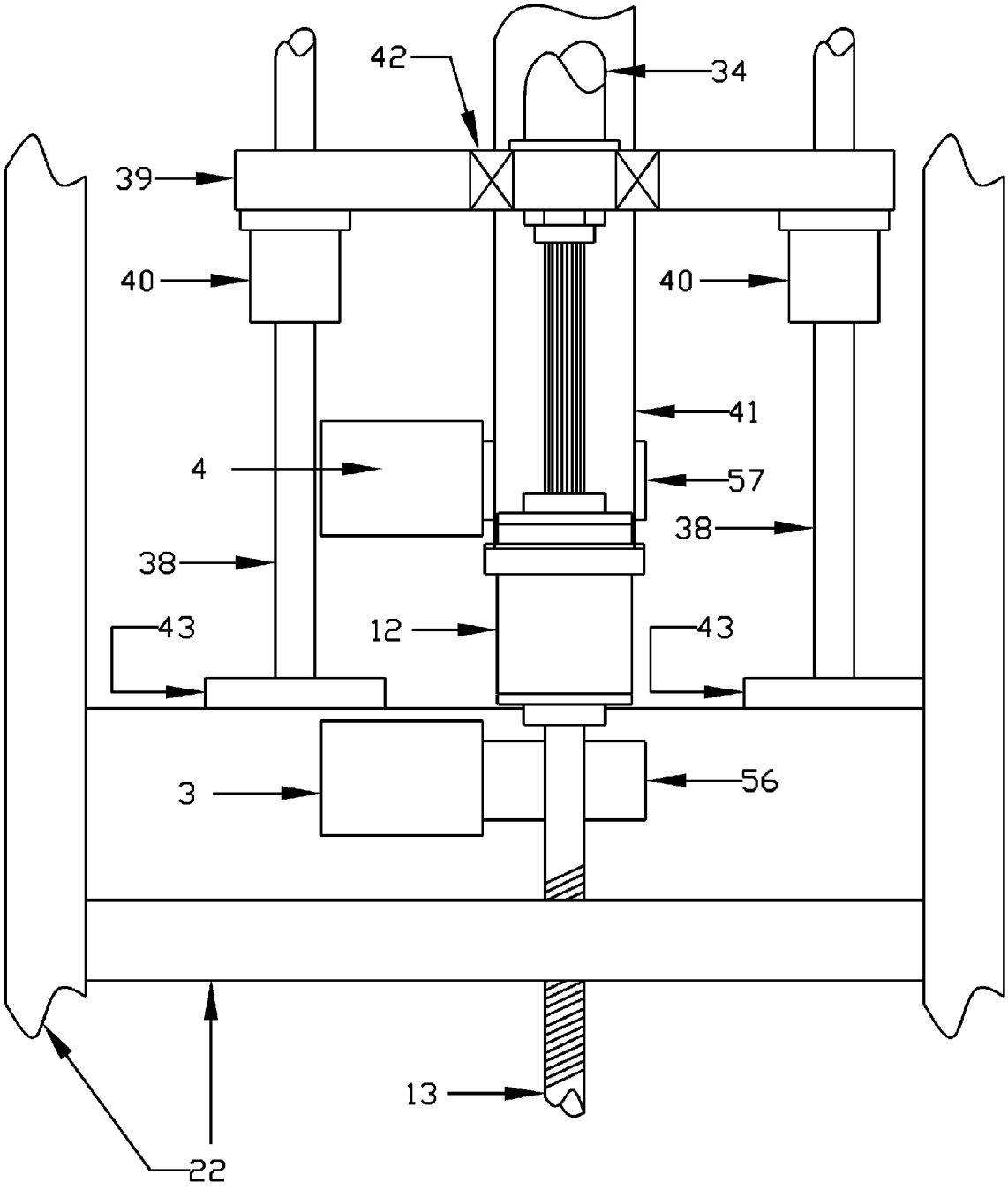
FIG. 4 is a side view of the lower portion of the machine used to carry out the process according to the invention.

FIG. 3 also shows the lift shaft 34, the slideway bars 38, the support plate 39, the slide bearings 40 and the support blocks 43, however, these elements of the present invention are better viewed in FIG. 4.

FIG. 4 shows part of the frame 22 supporting the ball screw/ball spline assembly 12 with the composite shaft 13 passing through the center of the ball screw/ball spline assembly 12. The composite shaft 13 is connected at its upper end to the lift shaft 34. The lift shaft 34 is set in a bearing 42 which is held in the support plate 39. Attached to the support plate 39 are three slide bearings 40 (only two are shown) which ride vertically on the three slideway bars 38 (only two are shown). The slideway bars 38 are fixed in position by the three support blocks 43 (only two are shown). The first servo drive motor 3 is shown connected to the gear or pulley drive system 56 which is connected to the ball screw/ball spline assembly 12 and the second servo motor 4 is shown connected to the gear or pulley drive system 57 which is connected to the ball screw/ball spline assembly 12. The standoff support 41 adds rigidity and support to the invention.

The commands of the software (not shown) can direct the servo motor 3 to operate, thereby causing motion in the gear or pulley drive system 56 and the ball screw/ball spline assembly 12, resulting in the composite shaft 13, and the attached lift shaft 34 to move upward or downward at various controlled speeds. While this linear motion is occurring, the software (not shown) through the second servo motor 4, can cause the gear or pulley drive system 57 and the ball screw/ball spline assembly 12 to rotate in either a continuous motion of various speeds or in a stop and index motion.

Combining these motions in a variety of ways through the software programming (not shown) can thus provide the composite shaft 13, the lift shaft 34, the support plate 39, the slide bearings 40, the carriage 25 and the workpiece 29 with a straight linear motion in either direction, a linear motion in either direction combined with a continuous rotation in either direction, a lift and hold motion for pop up hardening, or a lift and hold for hardening, then a drop, index and lift motion for individual spline or gear tooth hardening.

In another embodiment, the head stock 28 could be easily removed and replaced with a fixture (not shown) designed to hold a workpiece securely in position. Depending upon the workpiece and fixture design, this may or may not require the use of the tail stock 27. Similarly, the induction coil assembly 10 could be easily replaced with a coil designed to match the surface features of the workpiece for which hardening is desired.

Figure 5:
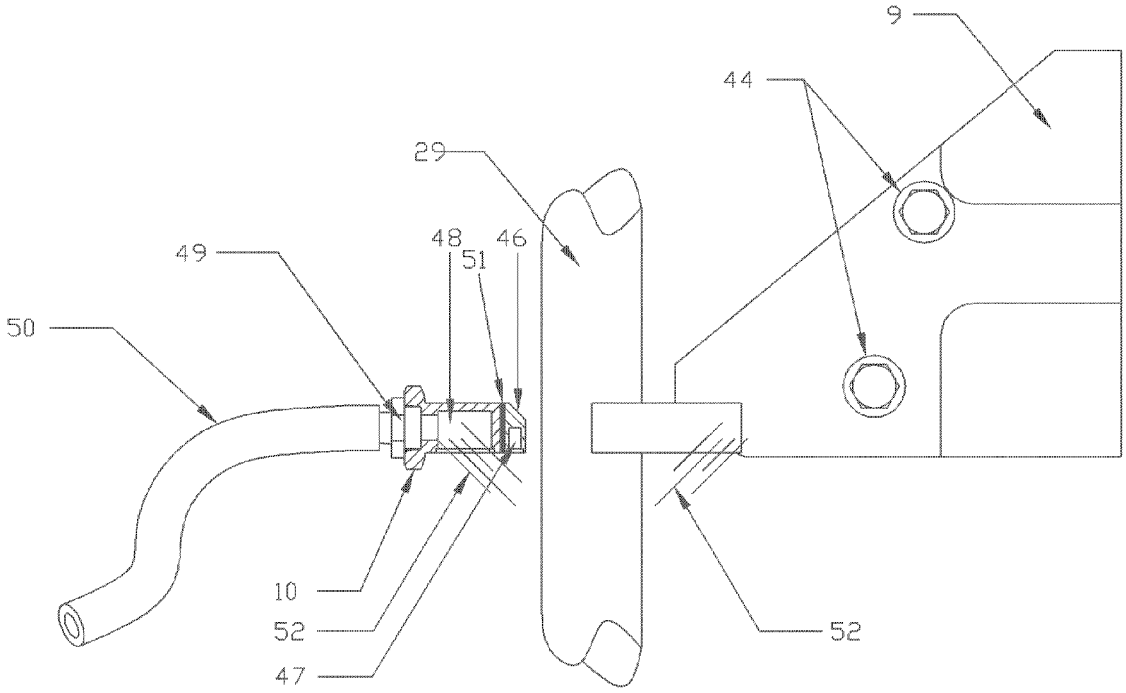
FIG. 5 is a cross sectional view of the workpiece and induction hardening and quenching coil taken on line I—I of FIG. 7.
Figure 7:
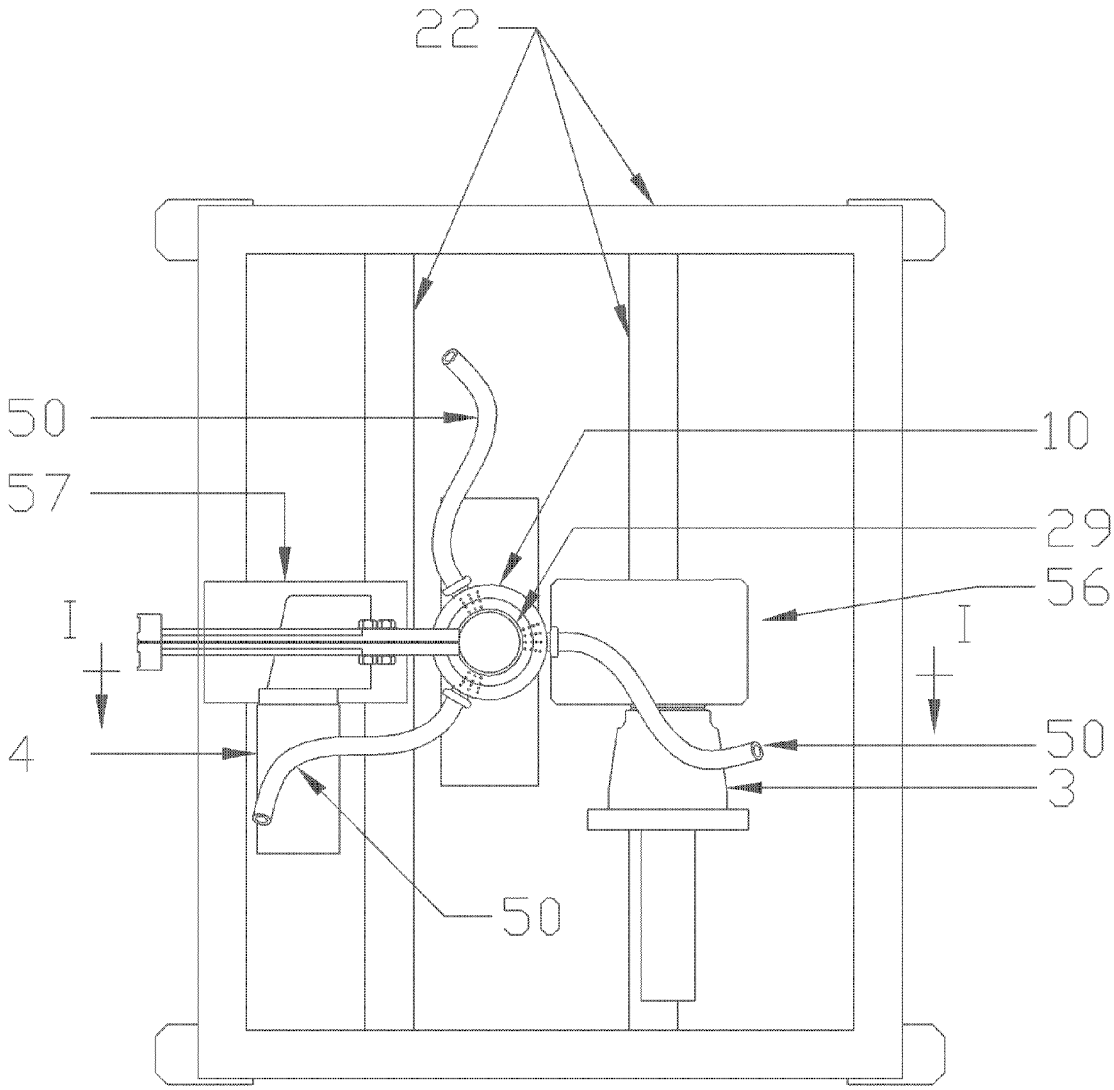
FIG. 7 is a cross sectional top view of the machine used to carry out the process of the invention taken on line II—II of FIG. 3.

FIG. 5 shows a sectional view of the induction coil assembly taken on line I—I of FIG. 7. The bolts 44 secure the induction coil assembly 10 to the buss bar 9. The induction coil assembly 10 surrounds the workpiece 29. The cross sectional view of the coil assembly 10 shows the induction coil 46 which contains coolant passages 47. An insulator 51 separates the induction coil 46 from the rest of the induction coil assembly 10. The induction coil assembly 10 contains quench passages 48 and 49 which are fed quench fluid through a flexible quench hose 50. The quench medium 52 sprays onto the workpiece 29 through the quench passage 48 to cool the workpiece after heating.

Figure 6:
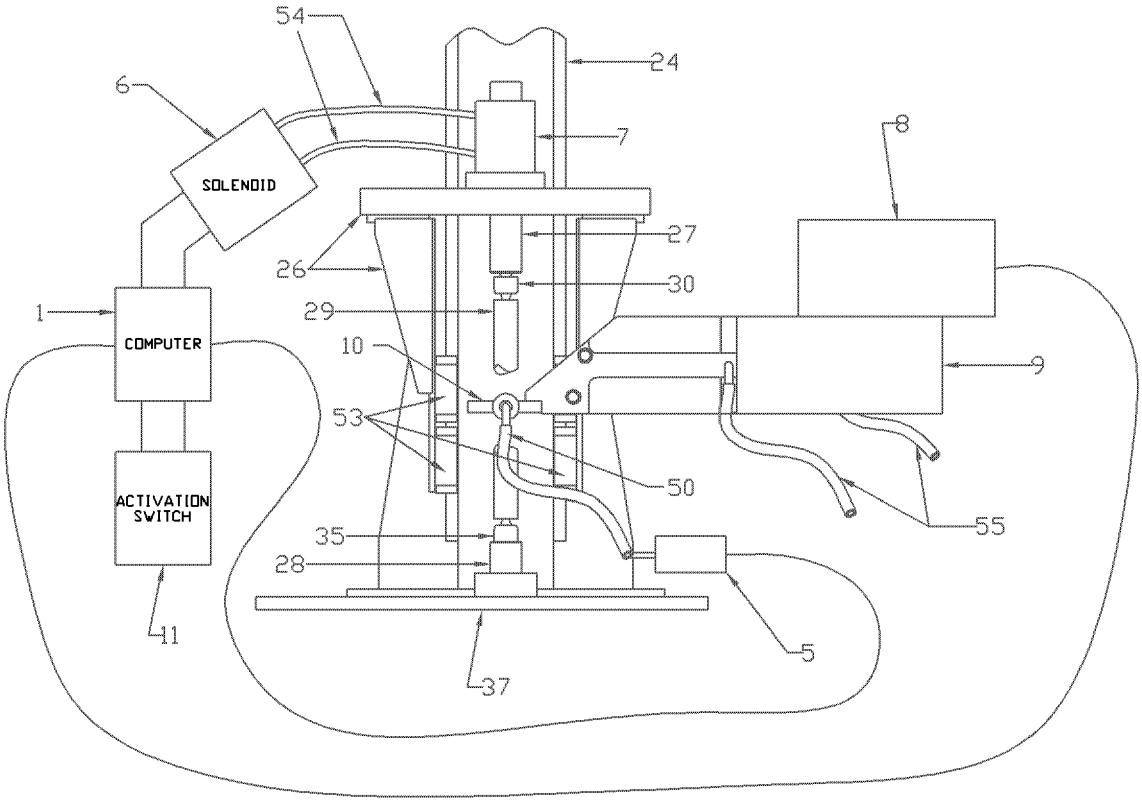
FIG. 6 is a front view of the upper half of the machine used to carry out the process according to the invention.

FIG. 6 shows a frontal view of the top half of the invention along with a schematic representation of the computer 1, the activation switch 11, the quench valve 5 and the solenoid for the air cylinder 6. As seen in FIG. 6, the activation switch 11 is connected to the computer 1 and the activation switch 11 must be manually activated for the computer 1 to direct the operation of all other attached components. The computer 1 is also connected to the solenoid 6 which sends pressurized air through the flexible air hoses 54 to and from the air cylinder 7, which is held in position by the support plate 26. When the air cylinder 7 is pressurized, it applies force downward on the tail stock 27 and the tailstock center 30 which then holds the workpiece 29 in place between the head stock center 35 and the tail stock center 30. The head stock center 35 is attached to the head stock 28. The head stock 28 is supported by the base plate 37.

The support plate 26 is attached to linear bearings 53 which slide up and down the slideway column 24. The flexible quench hoses 50 (only one is shown) are connected to the induction coil assembly 10, shown surrounding the workpiece 29 and is attached to the buss bar 9 which is connected to the transformer 8. Attached to the buss bar 9 are shown the flexible coolant hoses 55. The transformer 8 is shown connected to the computer 1.

FIG. 7 is a cross sectional view, taken from line II—II on FIG. 3 of the invention, with the drain pan of the upper frame cover 33 not shown to aid in understanding the invention. This view shows a cross sectional view of the workpiece 29 surrounded by the induction coil assembly 10. Attached to the induction coil assembly 10 are the three flexible quench hoses 50. Beneath that, mounted to the frame 22 is the first servo motor 3 shown connected to the gear or pulley drive system 56 which is connected to the ball screw/ball spline assembly 12 (not shown) which is connected to the composite shaft 13 (not shown). Similarly, the second servo motor 4 is shown connected to the gear or pulley drive system 57 which is connected to the ball screw/ball spline assembly 12 (not shown) which is also connected to ball screw/ball spline assembly 12 (not shown).

As shown in FIG. 4 the invention utilizes a ball screw/ball spline assembly 12 and a separate independent bearing 42 that fits onto the composite shaft 13 which is connected to a lift shaft 34 directly on center with the workpiece 29, in place of a cantilever as on existing prior art. This positioning allows for a greater mass to be moved utilizing the same floor space when compared to the existing cantilever designs. The servo motors 3 and 4, the power supply going to the induction coil assembly 12 and the controls for turning the quenching fluid on and off are connected to a computer 1. This configuration, along with the necessary controls, allows an operator (not shown) to program the invention to do the all of the following in one machine:

1. Through software (not shown) in the computer 1, the invention can do a continuous scan by raising the composite shaft 13 and lift shaft 34 through the use of the servo motor 3, the ball screw/ball spline assembly 12 and gear or pulley drive system 56, with a workpiece 29 loaded into the machine 2, at a programmed rate of speed, turn the induction coil assembly 10 on and off as directed by the software program in order to heat the workpiece to the desired temperature, turn the quench fluid 52 on and off as directed by the software program in order to quench the heat treated workpiece 29 and lower the workpiece back to its home position.

2. The device can do a continuous scan, as stated in 1 above, accompanied with either a continuous or indexing rotation of the composite shaft 13, the lift shaft 34 and the workpiece 29 at a predetermined rate of speed through the use of the servo motor 4, the gear or pulley drive system 57 and the ball screw/ball spline assembly 12.

3. The device can do a continuous scan, as stated in 1 and 2 above, and perform a tempering operation on the workpiece by keeping the induction coil assembly 10 charged and returning the workpiece 29 to its home position, either linearly or linearly with rotation, at a rate of return greater than the speed rate at which the workpiece was raised during heating.

4. The device can do a pop up type scan by raising the workpiece 29 or moving the induction coil assembly 10 into position and holding the workpiece 29 in position while the induction coil assembly 10 is charged for the desired time followed by quenching 52 and then returning the workpiece 29 to its home position.

5. The device can do the lift and index type of induction hardening by raising the workpiece 29 into position, having the induction coil 10 heat the gear tooth or spline surface, lowering the workpiece 29 away from the induction coil assembly 10, quenching 52 the heated area, indexing the workpiece 29, and then raising the workpiece 29 back into position so that the next tooth can be heat treated. This device can do all of this without having to move the induction coil in to and out of position. Thus it is faster, less expensive and has a longer equipment life.

The use of the computer software and applets (not shown) in combination with the design of the apparatus provides a method for combining all of the features of the three distinctly different induction heat treating methods currently in use into one machine and provides some significant benefits. First, it is less expensive to build than any of the individual machines now in use. Secondly, it allows the user to purchase one machine to do all of the work that currently requires three machines. Thirdly, it has a much greater weight capacity for the same amount of floor space. And fourth, as it relates to the lift and index method, the proposed method is faster and more precise over time because there is less wear on a center lift mechanism than there is on a cantilever system of the existing designs.

The Invention is claimed is:

1. A workpiece movement and positioning device, the workpiece being located on center with the movement and positioning device, the workpiece movement and positioning device comprising:

a frame for attaching the workpiece movement and positioning device;

a computer or control mechanism for turning on and off the workpiece movement and positioning device and other components and/or attachments;

an actuator consisting of a ball screw/ball spline assembly with servo motors and a lift shaft for providing the linear and rotational movement of the workpiece such that the workpiece can be caused to move linearly, linear and hold, linearly with rotation, and/or lift and index;

a means for moving the lift shaft linearly without undue bending or flexing;

a means for holding the workpiece in position on the lift shaft;

a manual safety switch to prevent the device from being operated unintentionally.

2. The workpiece movement and positioning device of claim 1 further comprising shielding and drain pans to contain any quench fluid and as a safety guard.

3. The workpiece movement and positioning device of claim 2 further comprising induction hardening and quenching means wherein the workpiece and hardening means can be operated in either a scan hardening process, a pop up induction hardening process and/or a lift and index hardening process.

4. The workpiece movement and positioning device of claim 2 further comprising other working tools controlled by the computer to perform work in the workpiece.

* * * * *